US007302999B2

(12) United States Patent
Hardy

(10) Patent No.: US 7,302,999 B2
(45) Date of Patent: Dec. 4, 2007

(54) SCRAPER BLADE AND METHOD FOR SCRAPED-SURFACE HEAT EXCHANGER

(75) Inventor: Benjamin Hardy, Elkorn, WI (US)

(73) Assignee: SPX Corporation, Charlotte, NC (US)

( * ) Notice: Subject to any disclaimer, the term of this patent is extended or adjusted under 35 U.S.C. 154(b) by 602 days.

(21) Appl. No.: 10/301,722

(22) Filed: Nov. 22, 2002

(65) Prior Publication Data

US 2004/0099405 A1 May 27, 2004

(51) Int. Cl.
*F28G 1/12* (2006.01)
*B08B 1/00* (2006.01)
*F16L 45/00* (2006.01)

(52) U.S. Cl. ..... 165/94; 165/95; 15/236.01; 15/104.16

(58) Field of Classification Search ..... 165/94, 165/95; 366/67, 309, 311–313; 15/236.01, 15/104.063, 104.16, 239
See application file for complete search history.

(56) References Cited

U.S. PATENT DOCUMENTS

| | | | | |
|---|---|---|---|---|
| 299,860 | A * | 6/1884 | Scofield | 165/94 |
| 2,629,310 | A | 2/1953 | Harder | |
| 2,713,474 | A * | 7/1955 | Read | 241/65 |
| 2,746,730 | A * | 5/1956 | Swenson et al. | 366/311 |
| 3,145,017 | A | 8/1964 | Thomas | |
| 3,385,354 | A | 5/1968 | Bevarly | |
| 3,848,289 | A * | 11/1974 | Bachmann | 15/246.5 |
| 4,088,185 | A * | 5/1978 | Carson | 166/176 |
| 4,185,352 | A * | 1/1980 | Smith | 15/246.5 |
| 4,282,925 | A * | 8/1981 | Hay et al. | 165/94 |
| 4,793,151 | A * | 12/1988 | Masel et al. | 62/306 |
| 5,462,408 | A * | 10/1995 | Coffy | 416/134 A |
| 6,286,332 | B1 | 9/2001 | Goldstein | 62/342 |
| 2003/0062063 | A1 * | 4/2003 | Sandu et al. | 134/1 |

FOREIGN PATENT DOCUMENTS

| | | |
|---|---|---|
| DE | 101 13 395 | 8/2002 |
| EP | 0 711 507 | 5/1996 |

* cited by examiner

*Primary Examiner*—Tho Duong
(74) *Attorney, Agent, or Firm*—Baker & Hostetler LLP

(57) ABSTRACT

A curved scraper blade for a scraped-surface heat exchanger pivots about an axis off the centerline of the blade. The profile of the blade is chosen to provide a low initial scrape angle and to change gradually if at all as the blade wears away in service. The off-center pivot placement allows scraped material to flow between the blade and the drive shaft. Several materials are suitable for the blade, including PEEK thermoplastic.

25 Claims, 5 Drawing Sheets

SCRAPER BLADE AND METHOD FOR SCRAPED-SURFACE HEAT EXCHANGER

FIELD OF THE INVENTION

The present invention relates generally to scraper blades for scraped-surface heat exchangers. More particularly, the present invention relates to materials and shapes for scraper blades and scraper methods used with scraped-surface heat exchangers.

BACKGROUND OF THE INVENTION

The scraped-surface heat exchanger (SSHE) is a well-established device used in continuous-flow heating or chilling of foodstuffs, pharmaceuticals, lubricants, and other materials requiring such thermal alteration (i.e., "products"). An additional effect of the use of an SSHE is stirring of products, which can involve combining ingredients, whipping gases into liquid materials, and other alterations to products. As currently manufactured, a representative SSHE can have a heat exchanger tube some 6" in diameter and roughly ten feet in length and can have a motor that provides on the order of four horsepower. SSHEs can be made that can operate in a horizontal or vertical position. Some are designed to be shifted to vertical orientation before disassembly for inspection and scraper blade exchange. The SSHE has met with excellent market acceptance, as a serviceable tool for modern industry.

An exemplary SSHE consists of a set of concentric layers, where the outermost layer is metal-skinned thermal insulation for safety, energy economy, thermal uniformity, and process control. Inside the insulation is the outermost pressure tube. Next inward is a chamber into which the thermal control medium—e.g., live steam, ethylene glycol, ammonia, fluorocarbons, or another heat exchange fluid—is introduced. The next inward layer is a second chamber, through which the product to be heated or cooled is forced. The innermost layer is a drive shaft that carries the scraper blades.

Continuous pressure keeps the product flowing longitudinally through the SSHE and prevents uncontrolled air from getting into the SSHE. Relative rotation between the drive shaft and the rest of the structure causes the scraper blades to scrape the product away from the thermally controlled product-chamber surface (i.e., the "scraped surface"). Scraping a layer of product away from the surface in a completely filled environment causes another portion of product to contact the scraped surface. The combination of forced flow and scraping determines the amount and duration of direct exposure of product to the scraped surface so that the cooling or heating meets process needs.

The scraper blades are free to pivot out from their connection to the drive shaft towards the thermally controlled scraped surface, until the leading edge of the blades contacts the scraped surface against which the blades are held by resistance from the fluid flow properties of the product when the drive shaft is rotated. Multiple blades staggered at different radial and axial orientations along the drive shaft provide enough overlap to ensure that the entire inner surface of the heat transfer tube is scraped continuously. A drive motor and appropriate mechanism provide torque for the relative rotation of the SSHE parts. Suitable seals prevent leakage and contamination.

Typically, the scraped surface must meet some or all of the following requirements. It must be chemically compatible with both the product being processed and the thermal control medium. It typically also must be suitable for contact with food or pharmaceuticals if the product is intended for human use. It must be reasonably efficient in transferring heat to and from the thermal control medium and the product involved. It is also generally desirable for the scraped surface to be significantly harder than the scraper blade, since the scraped surface is much more expensive and difficult to service and/or replace than the blades.

The scraper blades also typically must meet certain requirements. Various styles and materials for scraper blades have been used since the introduction of the SSHE. For example, blades have been made from stainless steel and other metals by machining them from flat stock. Such blades can show a wear pattern that leaves a feathered edge of blade material projecting outward along the scraping surface. Maintenance of blades to remove feathering requires disassembling the SSHE and grinding the blades to the original profile. After several grindings, the blades become too short to maintain a working angle of attack against the scraped surface that is within the acceptable range, so that the blades must be discarded. An additional consideration for metal scraper blades is the requirement that the heat transfer tube surface be extremely hard, which requires special production steps and periodic inspection, adding to production and maintenance costs.

Some plastics have proven suitable for blades, but are limited by the temperatures and friction environment of the SSHE. One, polytetrafluoroethylene (PTFE, commonly known by the Dupont® tradename of Teflon®) is FDA and/or USDA recognized for use on foods and other critical materials. However, PTFE cannot be molded, but must be machined, making it useful for prototypes but in some instances less desirable for mass production. Other plastics, such as Polyoxymethylene (Acetal) and Polyphenylene sulfide (PPS) can be significantly more long-wearing than PTFE in some applications and are injection moldable, which lowers cost if demand is sufficient. Most plastics considered for SSHE applications wear away without leaving a feather edge like metal, so such blades do not require sharpening. Being softer than stainless steel or nickel, they obviate the need for a hard inner surface coating on the SSHE heat transfer tube. Fillers—finely divided fiberglass, carbon filaments, and even talc—can improve some plastics' mechanical properties. A few fillers are FDA/USDA approved.

A disadvantage of the plastic blades described above is that even the most suitable of the plastics often exhibit more rapid wear than metal blades. This can obligate users to halt process operations more often than periodic maintenance requires, just to inspect or replace blades. Such halts, adding extra cooldown, cleanup, disassembly, and other maintenance steps, can add cost and interfere with production. Further, many plastics are not recognized by the U.S. Food and Drug Administration (FDA) or the United States Department of Agriculture (USDA) for use on foods, either in virgin form or with fillers.

Accordingly, it is desirable to provide a scraped-surface heat exchanger scraper blade that combines desirable manufacturability and scraping performance and improved blade life while having desirable SSHE properties.

SUMMARY OF THE INVENTION

It is an advantage and feature of some embodiments of the present invention to provide a scraped-surface heat exchanger scraper blade that combines desirable manufacturability and scraping performance and improved blade life while having desirable SSHE properties. Another advantage and feature of some embodiments of the invention is to provide a scraped-surface heat exchanger scraper blade with a profile that provides a generally constant angle of attack with respect to the heat transfer tube surface throughout the working life of the blade.

In one aspect, the invention provides a scraper for use in a scraped-surface heat exchanger having a drive shaft rotating relative to a scraped surface wherein the blade and/or scraping means has a first end with a mounting feature and/or mounting means for mounting to the drive shaft, and a second end with an edge for scraping contact against the scraped surface, and moreover wherein the blade and/or scraping means has a curved inward facing surface proximate the edge.

In another aspect, the invention provides a scraped surface heat exchanger using such a blade and/or scraping means.

In another aspect, the invention provides a method for scraping processed product from the inner surface of a heat transfer tube. The method of manufacturing a scraper blade for a scraped surface heat exchanger includes the step of forming a blade, having a first end with a mounting feature for mounting to a drive shaft of the heat exchanger, and a second end having an edge for scraping contact with a scraped surface of the heat exchanger, the blade having a curved inward facing surface proximate the edge.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the present invention provides a scraper blade injection—molded from a food-safe, high-temperature, high-stiffness, highly wear-resistant thermoplastic. The scraper blade in embodiments of the invention is preferably made at least partially or wholly from PEEK material. As used herein, "PEEK" refers to ketone polymer materials known as e.g., polyaryletherketones, including the materials known in the trade as PAEK, PEK, PEEK, and/or PEKK. As used herein, PEEK refers to all materials in the family of these ketone polymers. An example of these materials is the material sold under the brand name PEEK™ available from Victrex PLC. In another aspect the preferred embodiment has a blade shape that regardless of the material used can improve performance compared to conventional shapes, for example by maintaining a more constant angle of attack over its useful life. In some instances, the PEEK material choice offers the potential for reduced system stresses, longer maintenance intervals, and increased uniformity in products processed using blades of this shape.

Figure 1:
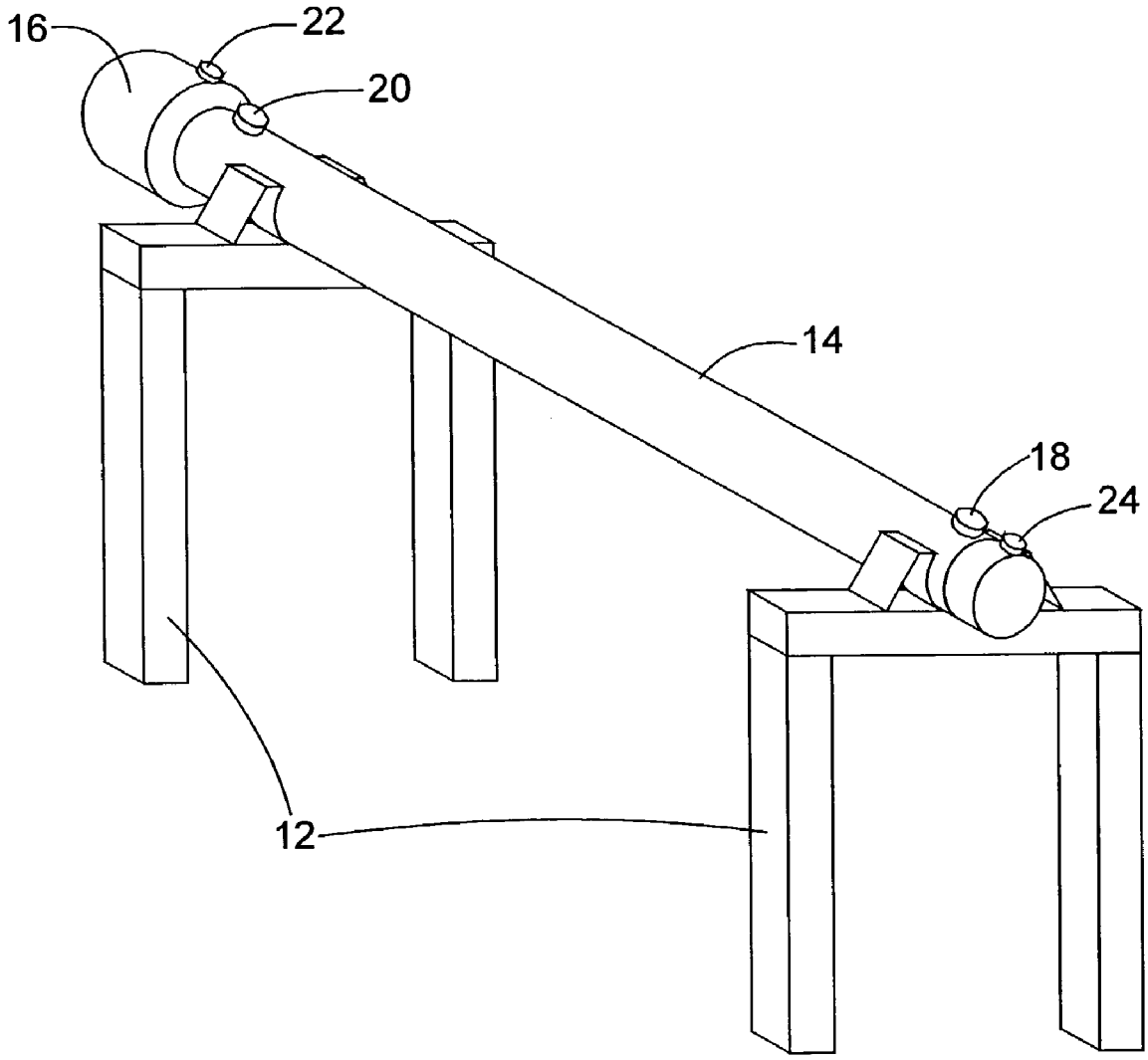
FIG. 1 is a perspective view illustrating the overall appearance of a scraped-surface heat exchanger (SSHE), such as one utilizing blades according to a preferred embodiment of the present invention.

FIG. 1 illustrates a scraped-surface heat exchanger (SSHE) capable of utilizing scraper blades according to a preferred embodiment of the present inventive apparatus and method. The SSHE 10 has a frame 12, an outer protective cover 14, a drive motor assembly 16, a first inlet fitting 18 and first outlet fitting 20 for the processed product, and a second inlet fitting 22 and second outlet fitting 24 for a heat transfer medium.

Figure 2:
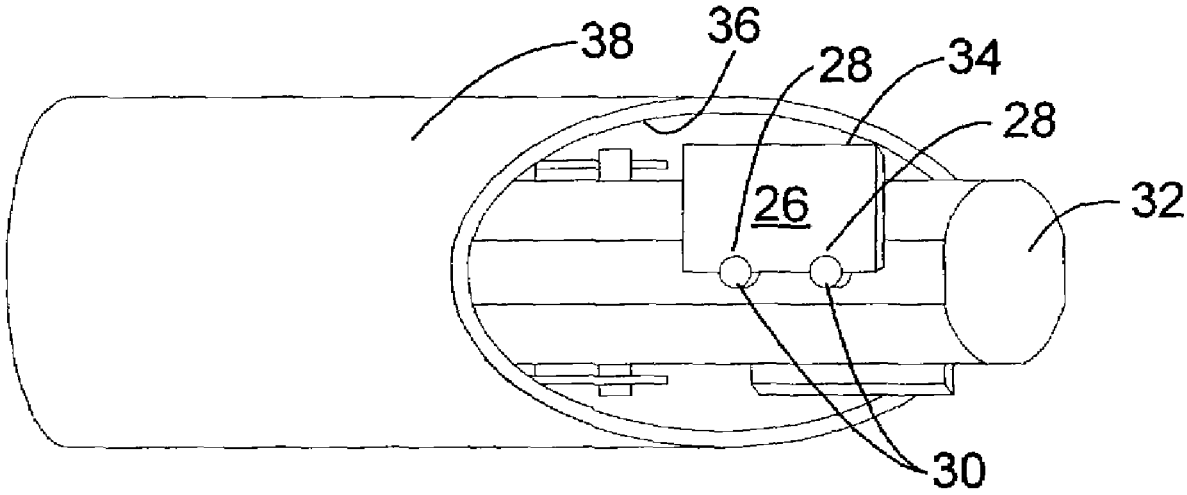
FIG. 2 is a partially cut-away view illustrating the relationship between some component parts of an SSHE, according to a preferred embodiment of the present invention.

FIG. 2, a cutaway view, shows a scraper blade 26, held in place at pin connection points 28 by two drive pins 30, which are attached in turn to a central drive shaft 32. A scraping edge 34 of the scraper blade 26 is shown riding against the inner scraped surface 36 of a heat transfer tube 38. FIG. 4 also shows the relationship between the blade 26 and pins 30. Although the blade 26 is shown flat, and in some embodiments of the invention can be a flat PEEK blade, it preferably is a curved blade 26 as shown in FIGS. 3 through 8.

Figure 3:
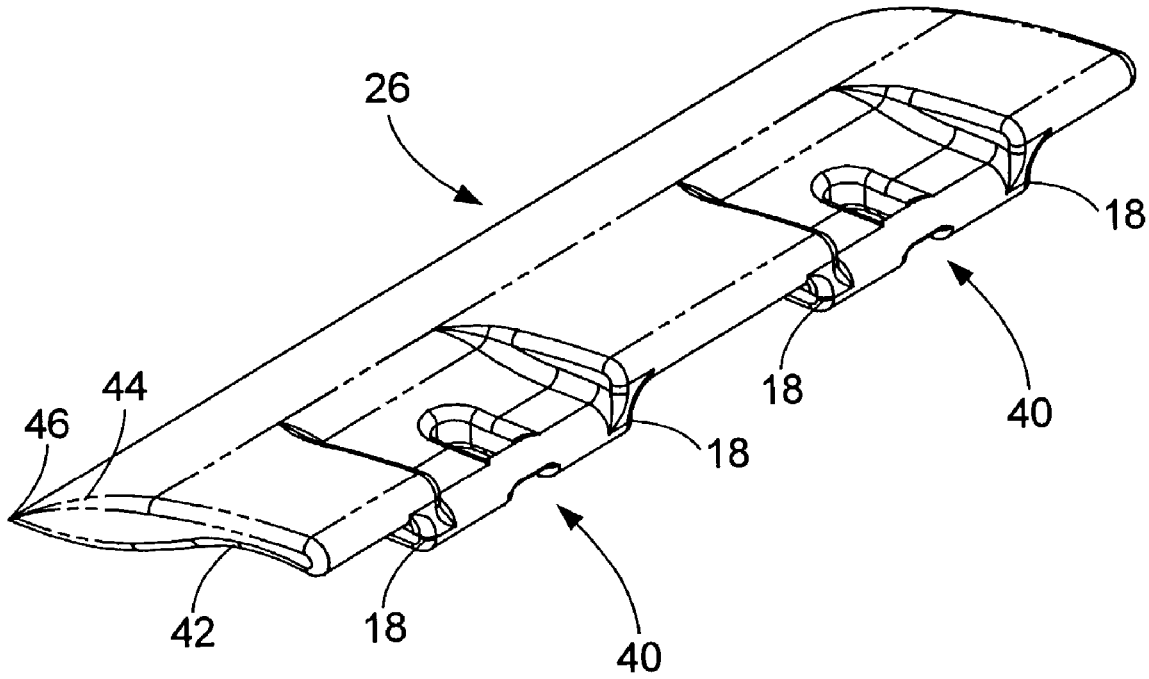
FIG. 3 is a perspective view of a scraper blade according to a preferred embodiment of the present invention.
Figure 4:
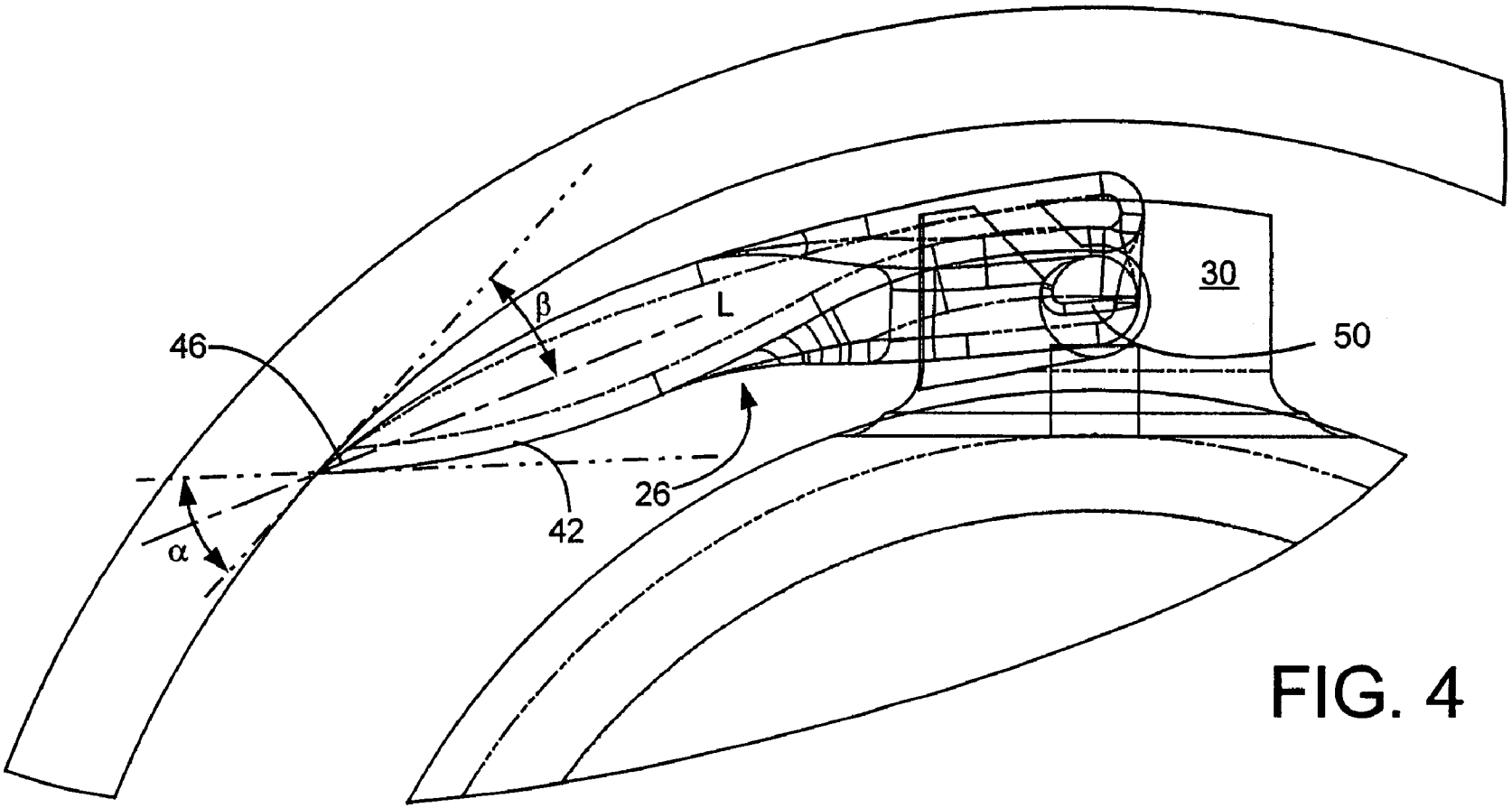
FIG. 4 is a detailed side view of a blade in contact with a scraped surface according to an embodiment of the invention.

FIGS. 3 and 4 show the geometry of an improved scraper blade 26. All surfaces of the blade 26 are preferably substantially free of recesses and irregularities that could trap contaminants. Features of this scraper blade 26 include two receptacles 40 to allow insertion to engage the drive pins 30. Pins 30 similar to those illustrated have been used previously for flat metal and plastic blades, and so the use of receptacles 40 makes the blade 26 interchangeable with previous flat blades in some instances. A curved bottom profile 42 (the side facing away from the scraped surface 36) has a geometry so configured that the change in the angle of departure with respect to the line of contact with the scraped surface can be controlled as the blade wears away. For example, the actual angle of departure of the scraping location can change minimally or not at all. A curved top profile 44 (the side facing the scraped surface 36) starts out with a slight angle with respect to the scraped surface 36—that is, the curve is not initially tangent to the scraped surface 36—but wears at least substantially into a tangent.

Figure 5:
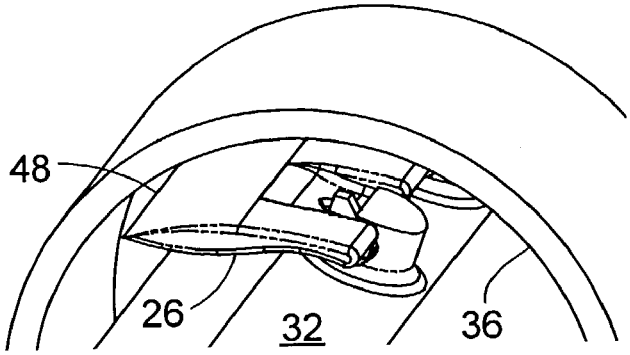
FIG. 5 is a view of a blade showing no wear.
Figure 6:
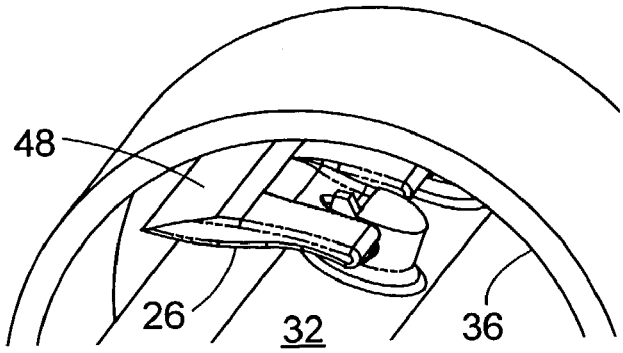
FIG. 6 is a view of a blade with some wear.
Figure 7:
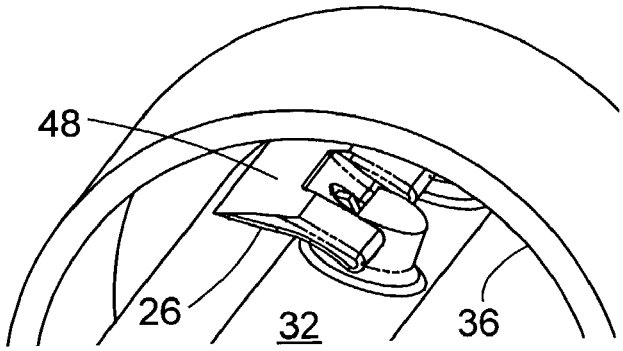
FIG. 7 is a view of a blade with more wear.
Figure 8:
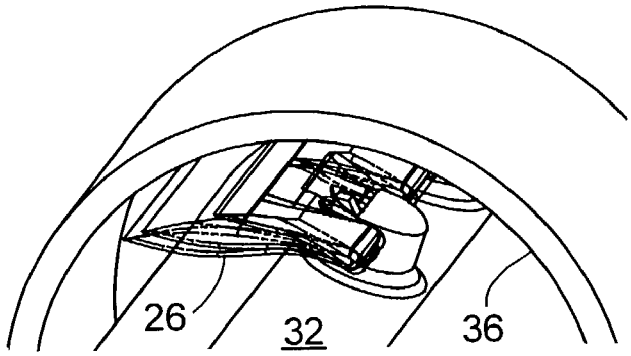
FIG. 8 is a view showing multiple superimposed blades with successive degrees of wear to illustrate the effect of wear in changing overall blade angle.

FIG. 4 shows the contact with a scraped surface 36 of a new unworn scraper blade 26 according to an embodiment of the invention. An unused scraper blade 26 has an initial bevel edge 46 producing an initial angle α with respect to a line tangent to the scraped surface 36 of 43 degrees. This angle α results from the production process; the leading edge 46 wears away in use to establish a small near-flat that conforms to the inside curve of scraped surface 36 of the heat transfer tube wear surface, known to those skilled in the art as the "heel". As the blade wears in use, the blade scrapes the surface at an angle α that steadily decreases to as little as 23 degrees. Such a progression in scrape angle can afford good pressure, heating, and wear characteristics. By comparison, a conventional flat blade could have a best angle of 35 degrees, which occurs near midlife and could increase thereafter until the blade is too short to use. Thus one advantage of some preferred embodiments is that the angle α between the blade and the scraped surface at the point of contact changes less with wear then with a conventional flat design, and the angles of attack α achieved can be made shallower than with a flat blade at most stages of blade life if desired. The result of this can be in some instances a smoother and more consistent lifting behavior of the product away from the heat transfer surface throughout the life of the scraper blade compared to a conventional flat blade combined with lower drag. The beneficial reduction in the change in angle due to wear is primarily a result of the curvature of the lower surface 42, particularly in the region of the tip 46. FIGS. 5 through 7 show a blade as it undergoes wearing from no wear (FIG. 5) to midlife (FIG. 6) to end of life (FIG. 7). Note that there is no heel 48 in FIG. 5, whereas in FIG. 6 the heel 48 is significant and in FIG. 7 the heel 48 dominates the top surface of the blade. FIG. 8 overlays multiple blades to show the change in blade body angle with wear.

An additional property of the preferred scraper blade embodiment is the positioning of the pin connection point 18, which is the pivot axis for the blade 26 with respect to the pin 30. The pin 30 used for the pivot axis 50 is preferably the same as in the prior art so that the scraper blade 26 then can be a direct exchange for conventional flat blades. The blade's pivot axis 50 is located quite close to the surface of the drive shaft on many SSHE models. In the preferred blade 26, the pivot axis 50 is preferably offset from the overall center line of the blade body, generally designated by line L in FIG. 4. This offset location effectively assists in lowering the blade attack angle with respect to the product flow path compared to a flat blade and forms a wider channel between the blade 26 and the drive shaft 32, which reduces turbulence.

A curved blade 26 as shown in FIG. 4 can pivot about the pivot point 50 less as it wears, compared to a flat blade, thus maintaining more constant slot path characteristics than flat blades in some instances. Further, due to the offset between the pivot axis 50 and blade body, the preferred scraper blade 26 can allow more scraped product to pass between the pin side of the blade and the drive shaft compared to a flat blade with a similar angle of contact, and can force less material to pass around the blade sides. This can leave the characteristics of the entire heat exchanger more nearly constant over scraper blade life, which is potentially useful for process control.

The preferred blade 26 is preferably molded from PEEK, which provides good injection molding capability and a combination of food safety, thermal range, mechanical toughness, and low coefficient of friction against typical scraping surfaces. In addition, the reliability and toughness of PEEK not only permit the complex blade shape of the blade, but also establish feasibility of its use for extreme temperatures, high pressures, caustics, and other applications that could otherwise require metal blades instead of plastics. However, blades having a shape according to the invention can be made from other materials, and can be fabricated by processes other than injection molding.

The scraper blade bottom curve 42 shown in the preferred embodiment in FIGS. 3 and 4 is preferred for some typical dimensions of center tube and heat transfer tube, as well as some typical viscosities of product being processed. This profile can be modified to adjust the ratio of drag versus lifting pressure at the scraped surface of the heat transfer tube, based on e.g. viscosity of the product and heat exchanger dimensions.

In addition to the concentric-cylinder heat exchanger designs discussed herein, an SSHE can employ an eccentric heat transfer tube, that is, one in which the tube is not concentric with the drive shaft, or in which the tube is noncylindrical. In these cases, the angle, and even the curvature, of the scraped surface of the heat transfer tube at the point of contact with the scraper blade can vary continuously, so the wear pattern on the friction surface of the scraper blade can be different from that of the concentric design. The heel of the scraper blade acquires greater curvature in these systems, and, since the curvature exceeds that of the scraped surface of the heat transfer tube, the contact pressure is greater, leading to the potential for more rapid wear, which is generally traded off against the potential for superior scraping performance with particular types of materials. For a preferred embodiment of the present invention, the shape of the top surface 44 of an unused blade—the surface closest to the heat transfer tube—can be such that the contact line remains the line furthest from the pivot at every drive shaft position. Once the blade is used, it will wear so that the line of contact is not the edge except at the extreme of travel.

The many features and advantages of the invention are apparent from the detailed specification; thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described. Accordingly, all suitable modifications and equivalents may be resorted to, that fall within the scope of the invention.

What is claimed is:

1. A scraper for use in a scraped-surface heat exchanger having a drive shaft rotating relative to a scraped surface, the drive shaft rotating about a central axis of the scraper, comprising:

a blade having a first end with a mounting feature for mounting to the drive shaft, and a second end having an edge for scraping contact with the scraped surface, wherein the blade has a convex curved inward facing surface proximate the edge, said inward facing surface facing towards the central axis when the blade is installed, and a convex curved outward facing surface, said outward facing surface facing away from the central axis when the blade is installed, and wherein the inward facing and outward facing convex surfaces both meet at the second end to form a tip.

2. A scraper according to claim 1, wherein at least part of the blade is manufactured from a ketone polymer.

3. A scraper according to claim 1 wherein the blade is molded.

4. A scraper according to claim 1, wherein the blade is molded from a ketone polymer.

5. A scraper according to claim 1, wherein the drive shaft has at least two pins projecting therefrom, and the blade has at least two mounting receptacles projecting through the blade which receive the pins.

6. A scraper according to claim 1, wherein the blade has a body and can pivot relative to the drive shaft so that a pivot angle β of the body relative to the scraped surface can change.

7. A scraper according to claim 6, wherein the convex curved outer surface curves away from the scraped surface so that, when the blade is shortened due to wear, an angle of attack α of the tip against the scraped surface changes at a rate less than the rate of change in angle β.

8. A scraper for use in a scraped-surface heat exchanger having a drive shaft rotating relative to a scraped surface, the drive shaft rotating about a central axis of the scraper, comprising:

scraping means for scraping the scraped surface, having a first end distal to the scraped surface and having a second end with an edge for scraping contact with the scraped surface, wherein the scraping means has a convex curved inward facing surface proximate the edge, said inward facing surface facing towards the central axis when the blade is installed, and a convex curved outward facing surface, said outward facing surface facing away from the central axis when the scraping means is installed, and wherein the inward facing and outward facing convex surfaces both meet at the second end to form a tip; and mounting means for pivotally mounting the scraping means to the drive shaft.

9. A scraper according to claim 8, wherein at least part of the scraping means is manufactured from a ketone polymer.

10. A scraper according to claim 8, wherein the scraping means is molded.

11. A scraper according to claim 8 wherein the scraping means is molded from a ketone polymer.

12. A scraper according to claim 8, wherein the drive shaft has at least two pins projecting therefrom and the mounting means has receptacles projecting through the blades which receive the pins for mounting the scraping means.

13. A scraper according to claim 8, wherein the scraping means has a body and can pivot relative to the drive shaft so that a pivot angle β of the body relative to the scraped surface can change.

14. A scraper according to claim 13, wherein the convex curved outer surface curves away from the scraped surface so that the when the scraping means is shortened due to wear, an angle of attack α of the edge against the scraped surface changes at a rate less than the rate of change in angle β.

15. A scraped-surface heat exchanger, comprising:

a scraped surface;

a drive shaft rotating relative to the scraped surface, the drive shaft rotating about a central axis of the scraper; and a blade having a first end with a mounting feature for mounting to the drive shaft, and a second end having an edge for scraping contact with the scraped surface wherein the blade has a convex curved inward facing surface proximate the edge, said inward facing surface facing towards the central axis when the blade is installed, and a convex curved outward facing surface, said outward facing surface facing away from the central axis when the blade is installed, and wherein the inward facing and outward facing convex surfaces both meet at the second end to form a tip.

16. A scraped-surface heat exchanger according to claim 15, wherein at least part of the blade is manufactured from a ketone polymer.

17. A scraped-surface heat exchanger according to claim 15, wherein the blade is molded.

18. A scraped-surface heat exchanger according to claim 15, wherein the blade is molded from a ketone polymer.

19. A scraped-surface heat exchanger according to claim 15, wherein the drive shaft has at least two pins projecting therefrom, and the blade has at least two mounting receptacles projecting through the blade which receive pins on the drive shaft.

20. A scraped-surface heat exchanger according to claim 19, wherein the blade has a blade body and can pivot relative to the drive shaft so that a pivot angle β of the blade body relative to the scraped surface can change.

21. A scraped-surface heat exchanger according to claim 20, wherein the convex curved outer surface curves away from the scraped surface so that the when the blade is shortened due to wear, an angle of attack α of the tip against the scraped surface changes at a rate less than the rate of change in angle β.

22. A method of manufacturing a scraper blade for a scraped surface heat exchanger having a drive shaft rotating relative to the scraped surface, the drive shaft rotating about a central axis of the scraper, comprising the step of:

forming a blade, having a first end with a mounting feature for mounting to a drive shaft of the heat exchanger, and a second end having a tip for scraping contact with a scraped surface of the heat exchanger, said blade having a convex curved inward facing surface proximate the tip, said inward facing surface facing towards the central axis when the blade is installed, and a convex curved outward facing surface, said outward facing surface facing away from the central axis when the blade is installed, and wherein the inward facing and outward facing convex surfaces both meet at the second end to form a tip.

23. A method according to claim 22, wherein the forming step comprises molding the blade.

24. A method according to claim 22, wherein the blade is formed from a ketone polymer.

25. A method according to claim 22, wherein the forming step comprises molding the blade from a ketone polymer.

* * * * *